United States Patent [19]

Yoshida et al.

[11] Patent Number: 4,704,855

[45] Date of Patent: Nov. 10, 1987

[54] WIRE TWISTING DEVICE

[75] Inventors: Kinji Yoshida; Kazuo Iura, both of Izumi, Japan

[73] Assignee: Sumitomo Wiring Systems, Ltd., Japan

[21] Appl. No.: 874,297

[22] Filed: Jun. 13, 1986

[30] Foreign Application Priority Data

Apr. 27, 1984 [JP] Japan ..... 59-87431

[51] Int. Cl.[4] ..... D01H 7/86

[52] U.S. Cl. ..... 57/58.54; 57/58.49; 57/58.65

[58] Field of Search ..... 57/58.52, 58.54, 58.55, 57/58.63, 58.67, 58.3, 58.36, 58.38, 58.49, 58.57, 58.59, 58.65, 58.7, 58.83, 58.86, 59, 60, 64, 66–68, 71, 11, 12, 13, 293, 294

[56] References Cited

U.S. PATENT DOCUMENTS

| | | | |
|---|---|---|---|
| 3,355,867 | 12/1967 | Yoshida | 57/58.54 |
| 3,491,525 | 1/1970 | Sugi | 57/63 X |
| 3,715,877 | 2/1973 | Akachi | 57/293 X |
| 4,133,167 | 1/1979 | Schofield | 57/12 |
| 4,328,662 | 5/1982 | Bretegwier et al. | 57/58.65 X |
| 4,339,913 | 7/1982 | Vogelsberg | 57/293 X |
| 4,599,853 | 7/1986 | Varga-Papp | 57/311 X |

*Primary Examiner*—Donald Watkins

*Attorney, Agent, or Firm*—Jordan B. Bierman

[57] ABSTRACT

A device for twisting multi-stranded wires having a first twisting portion comprising a supply reel carrying the wire and a first flyer bow rotatable about the axis defined by its ends. A second twisting portion, downstream of the first portion, has a second flyer bow which rotates about the axis defined by its ends. Means are provided for drawing the wire through the first portion and into the second portion and onto a take up reel. The wire is twisted in each of the first and second portions.

In a preferred form of the device, a wire divergence plate, having a plurality of holes, is provided downstream of the supply reel. A convergence die is located downstream of the plate and upstream of the upstream end of the first flyer bow. The strands of wire pass separately through the holes and are brought together when passing through the die.

16 Claims, 3 Drawing Figures

WIRE TWISTING DEVICE

This invention is directed to a device which is capable of twisting a plurality of wire strands; more particularly for twisting electrically conductive wires useful as communications cables, appliance wires, automobile wiring harnesses, and the like.

The prior art devices comprise a plurality of wire supply reels on which the strands to be twisted are separately wound. There is a take up reel and a rotating flyer bow. As described in U.S. Pat. No. 4,087,956, the feed wires from the supply reels are converged and twisted when the flyer bow rotates about its axis. However, such devices suffer from certain defects; specifically, the wires passing along the flyer bow are likely to be damaged when the speed of the bow is increased. Under such circumstances, the wires will collide with the inner surface of the bows and become abraded as a result. Since the strands of wire are extremely fine, breakage can occur, with the resultant imperfections in the final product.

Moreover, such prior art devices uniformly require a plurality of supply reels, one for each of the intended strands. Since many stranded wires are made up of a large number of such strands, the necessary provision of an equal number of reels becomes difficult, cumbersome, and prone to tangling and breakage.

SUMMARY OF THE INVENTION

The present invention is capable of providing a group of electrically conductive wires with double the number of twists of the resulting stranded wire when compared with prior art devices. Moreover, this can be accomplished without the necessity of increasing the speed of rotation of the flyer and, therefore, avoids the tendency of the prior art devices to cause breakage of the strands.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
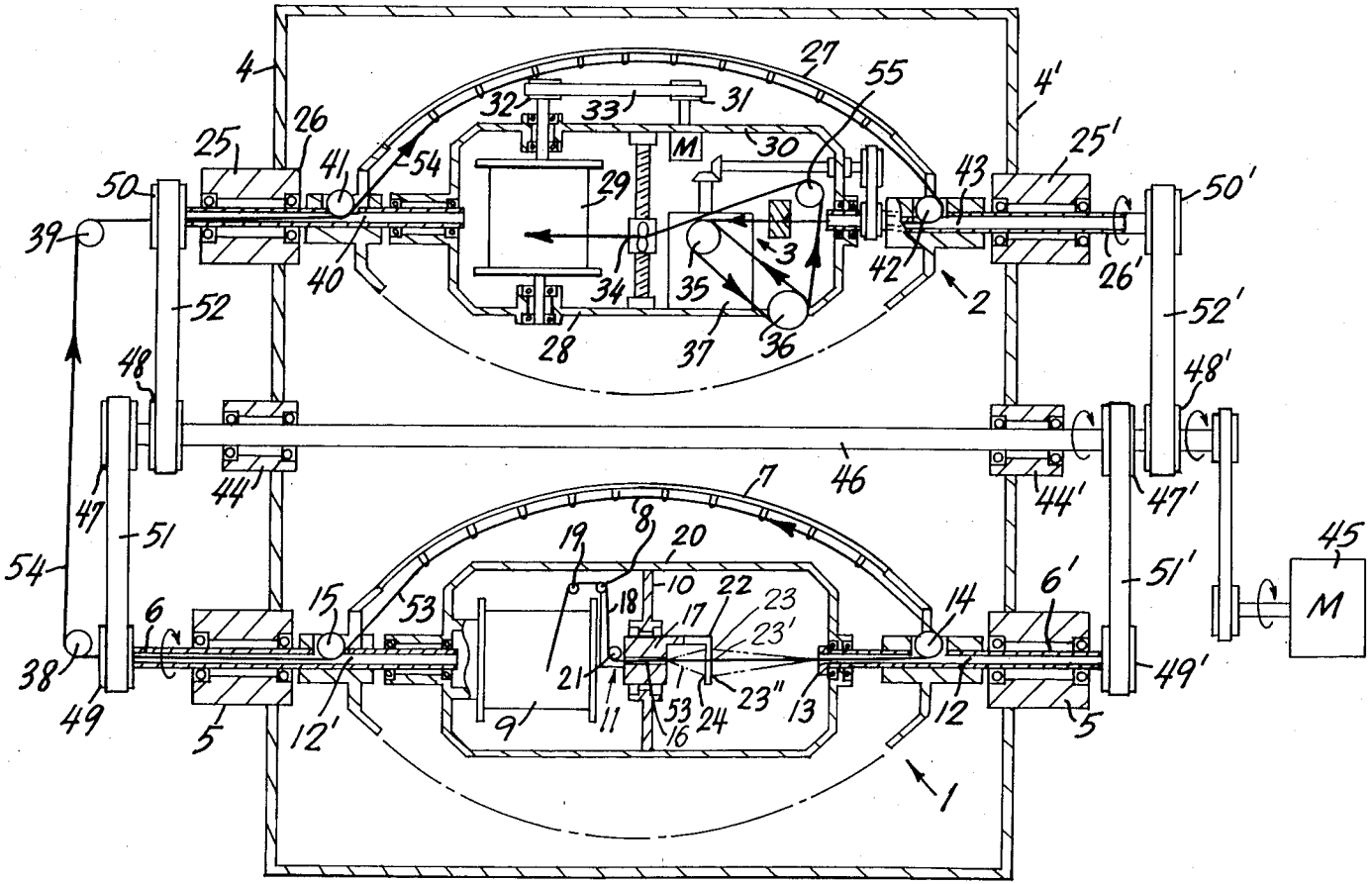
FIG. 1 is a cross-sectional view of the device of the present invention.

As can best be seen in FIG. 1, the device of the present invention comprises broadly first twisting portion 1 and second twisting portion 2. Traction means 3 pulls the wire from supply reel 9 through first twisting portion 1, through and into twisting portion 2 and onto take up reel 29. Both twisting portions are maintained in frames 4 and 4'.

First portion 1 comprises bearings 5 and 5' by which main shafts 6 and 6' are mounted on frames 4 and 4', respectively. First flyer bow 7 is mounted on shafts 6 and 6' and adapted to rotate thereabout. Within the volume defined by the rotation of flyer bow 7, supply reel 9, flyer 11, wire divergence plate 24 and convergence die 13 are located.

Figure 2:
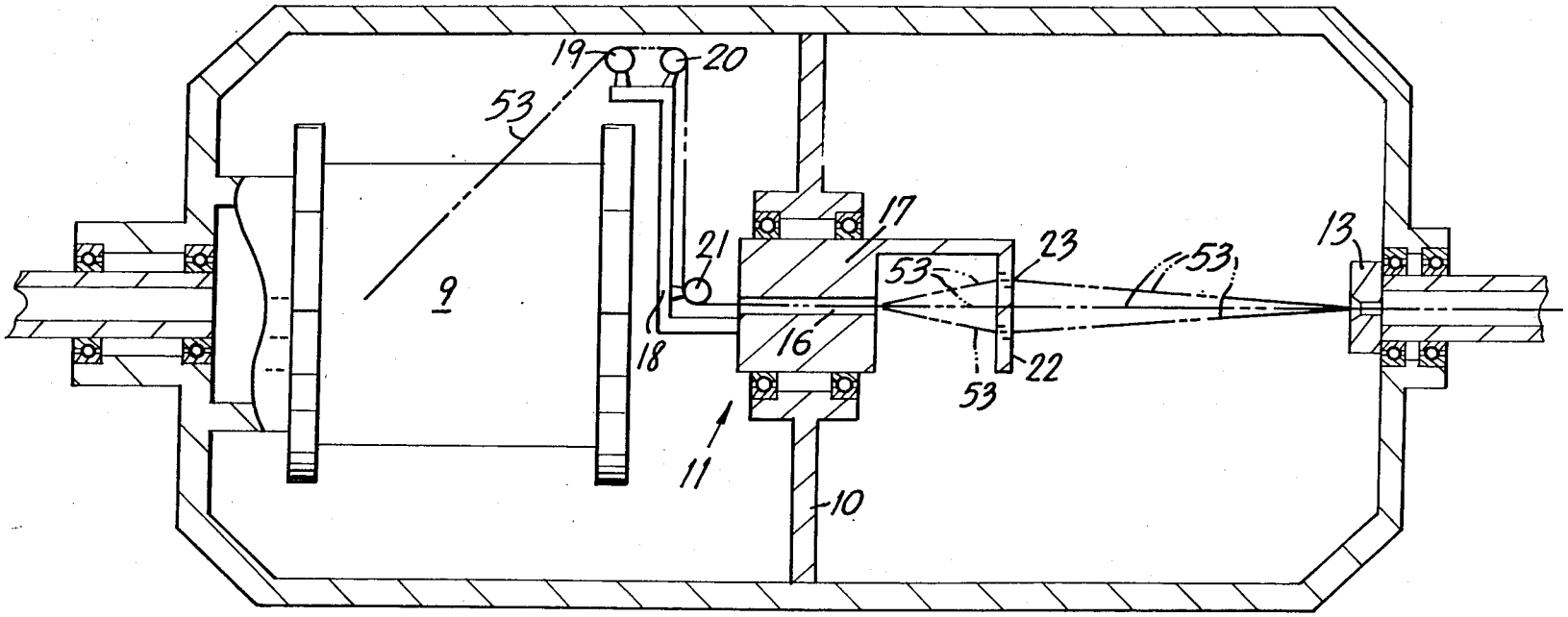
FIG. 2 is an enlarged cross-sectional view of the flyer of the present invention.

Referring more particularly to FIG. 2, supply reel 9 carries a plurality of strands 53 which are taken off and pass over guide pulleys 19, 20, and 21, all of which are mounted on arm 18. Rotator 17, having hollow 16 axially therethrough, is rotatably mounted on bearings in frame 10. Strands 53 pass through hollow 16 and individually through holes 23, 23' and 23'' in arm 22. Strands 53 then enter convergence die 13 through hollow 12 and thereafter are led around sheave 14.

The rotation of flyer bow 7 puts a twist in strands 53 to form wire 54 which passes along flyer bow 7, around sheave 15, and out through hollow 12'. It is then led around guide pulleys 38 and 39 and into second twisting portion 2 through hollow 40.

In a manner similar to that described with relation to first twisting portion 1, partially twisted wire 54 passes along second flyer bow 27, around guide sheave 42, through hollow 43 and enters traction means 3. Wire 54 passes around drive capstan 35 and capstan 36 in a loop and then around sheave 55, through traverser 34 and onto take up reel 29. As in the case of first twisting portion 1, a twist is given to wire 54 by the rotation of second flyer bow 27. The device is powered by motor 45 through various belts and pulleys in a manner well known in the art and adequately shown in the drawings.

Figure 3:
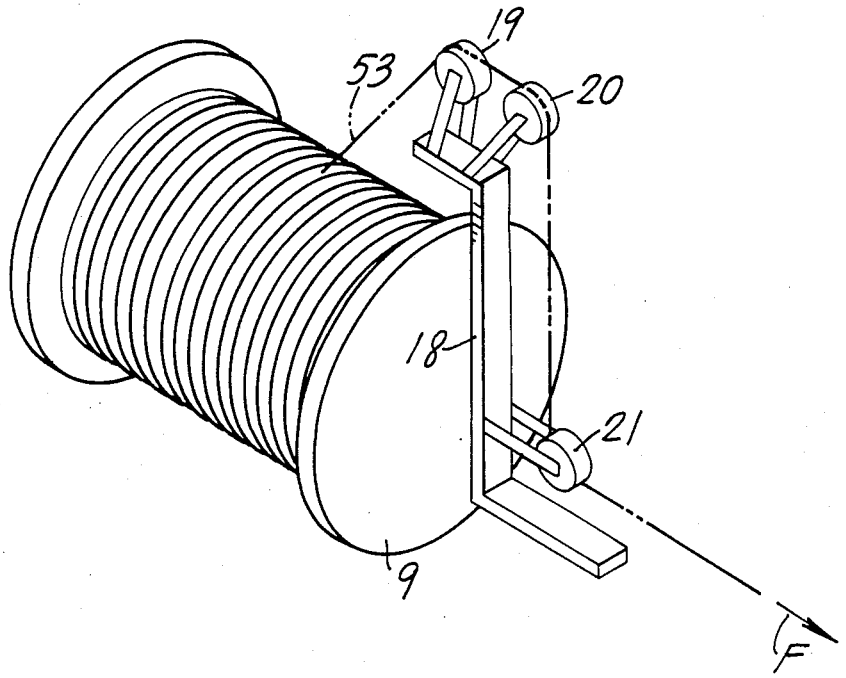
FIG. 3 is an enlarged perspective view of the supply reel and the flyer arm of the present invention.

FIG. 3 is an enlarged perspective view of supply reel 9 and the associated portion of flyer 11. Strands 53 are taken off supply reel 9 and pass over guide pulleys 19, 20, and 21, which are mounted on arm 18. The other end of arm 18 is secured to rotator 17 through which strands 53 pass.

As can be seen from the foregoing, the present invention permits a higher degree of twisting per unit length of the finished wire. This is because the twisting portions are cumulative and, for a given speed of wire movement and flyer bow rotation, introduce twice the number of twists as are obtainable by the prior art. In addition, the invention permits the use of a single supply reel, rather than the large number which have been used previously. This reduces breakage and tangling of the strands.

In a preferred form of the device, the relative velocity of rotation of arm 18 is such that it is substantially equal to the peripheral speed of take up reel 29. In this way, the tension on strands 53 is minimized. This is of importance because these strands are usually extremely fine and hence are easily broken.

It will be appreciated that, in the present device, the wire is twisted a total of four times. A twist occurs at sheave 14, sheave 15, guide sheave 41, and guide sheave 42. If the distances between successive sheaves are not equal, the wire will not be twisted unless the bow rotation rate relative to the wire speed is adjusted. Therefore, it is a particularly preferred form of the device to arrange the elements in a manner such that the distances between sheaves 14 and 15 and guide sheaves 41 and 42 are substantially equal. In this manner, an even twist is provided to the wire.

If the floor space for the device is at a premium, it is desirable to place the second twisting portion on top of the first twisting portion. This enables the dual device of the present invention to be located in the same floor space as would be required for the single devices of the prior art.

While only a limited number of specific embodiments have been expressly described, the present invention is, nonetheless, to be broadly construed, and not to be limited except by the character of the claims appended hereto.

What we claim is:

1. A device for twisting wire having a plurality of strands which comprises a first twisting portion having a supply reel carrying said wire, and a first flyer bow rotatable about a first axis defined by the ends of said first bow, a second twisting portion, downstream of said first portion, having a second flyer bow rotatable about a second axis defined by the ends of said second bow, means for drawing said wire through said first portion and into said second portion, a take up reel adapted to receive said wire, means for rotating said flyer bows about said first and second axes, whereby said wire is twisted by said first and second portions.

2. The device of claim 1 comprising a wire divergence plate, having a plurality of holes therethrough adjacent said supply reel and downstream thereof, a convergence die downstream of said divergence plate and upstream of the upstream end of said first flyer bow, said strands passing separately through said holes and are brought together when passing through said die.

3. The device of claim 1 wherein only a single supply reel is provided.

4. The device of claim 1 wherein said supply reel is within a first volume defined by rotation of said first bow around said first axis.

5. The device of claim 1 wherein said take up reel is within a second volume defined by rotation of said second bow around said second axis.

6. The device of claim 1 wherein said first and second bows rotate in opposite directions about said first and second axes, respectively.

7. The device of claim 1 comprising a flyer downstream of said supply reel and upstream of said divergence plate and including a rotor with an axial opening therethrough, an arm mounted on said rotor adapted to rotate therewith and located adjacent said supply reel, whereby said wire passes through said axial opening after leaving said supply reel and before passing through said divergence plate.

8. The device of claim 1 wherein said second portion comprises a traverse adjacent said take up reel and adapted to move parallel to the axis thereof, said wire passing through said traverse.

9. The device of claim 1 having a first distance between the ends of said first bow, a second distance between the upstream and downstream ends of said second bow, said distances being substantially equal.

10. The device of claim 1 wherein said second twisting portion is located on top of said first twisting portion.

11. The device of claim 1 wherein said means for rotating said flyer bows comprises driving means for rotating a line shaft, first and second spinning means on said line shaft, said first spinning means coupled to said first flyer to cause rotation thereof, said second spinning means coupled to said second flyer to cause rotation thereof, whereby both of said flyer bows are driven by said line shaft.

12. The device of claim 11 wherein said driving means is a motor.

13. The device of claim 11 wherein said second twisting portion is located on top of said first twisting portion.

14. The device of claim 11 wherein said first and second bows rotate in opposite direction about said first and second axes, respectively.

15. The device of claim 11 having a first distance between the ends of said first bow, a second distance between the upstream and downstream ends of said second bow, said distances being substantially equal.

16. The device of claim 11 wherein only a single supply reel is provided.

* * * * *